US009032843B2

(12) United States Patent
Johnson

(10) Patent No.: US 9,032,843 B2
(45) Date of Patent: May 19, 2015

(54) COMPOUND HAMMER TOOL

(71) Applicant: Scott Johnson, New Haven, KY (US)

(72) Inventor: Scott Johnson, New Haven, KY (US)

( * ) Notice: Subject to any disclaimer, the term of this patent is extended or adjusted under 35 U.S.C. 154(b) by 207 days.

(21) Appl. No.: 13/868,006

(22) Filed: Apr. 22, 2013

(65) Prior Publication Data

US 2014/0311298 A1 Oct. 23, 2014

(51) Int. Cl.
*B25F 1/00* (2006.01)
*B25D 1/00* (2006.01)

(52) U.S. Cl.
CPC . *B25D 1/00* (2013.01); *B25F 1/003* (2013.01); *B25F 1/006* (2013.01); *B25D 2250/065* (2013.01)

(58) Field of Classification Search
CPC ..... B25F 1/006; B25B 7/22; B25D 1/00
USPC ..... 81/20; 7/144
See application file for complete search history.

(56) References Cited

U.S. PATENT DOCUMENTS

2011/0113565 A1* 5/2011 Huffman ..... 7/144

* cited by examiner

*Primary Examiner* — David B Thomas

(57) ABSTRACT

A compound tool formed preferably of a single piece, having a grip stem adapted to be gripped by the jaws of adjustable pliers received in a recess on the tool, and having a hammer head. Together the plier and tool are useable as a hammer.

8 Claims, 5 Drawing Sheets

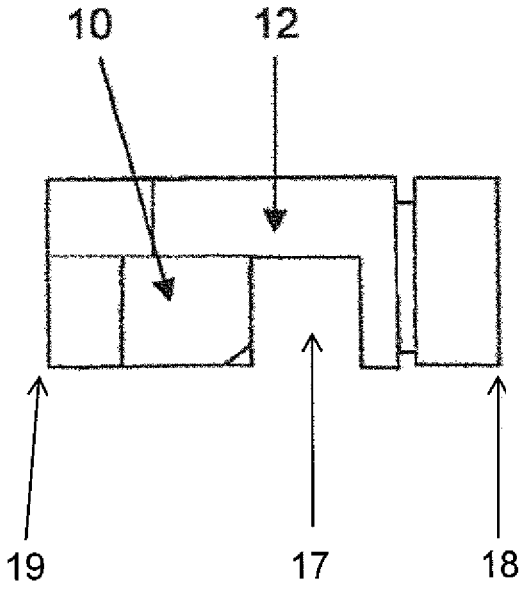
10
12
19
17
18

COMPOUND HAMMER TOOL

This application claims the benefit of U.S. provisional application 61/573,648, and of U.S. utility application Ser. No. 13/607,334.

In a variety of maintenance settings, persons moving around several areas must choose which tools will be carried with them and which will say in a tool room or box. A common goal is to carry enough to perform the anticipated maintenance work but only when necessary are larger or heavier tools carried. Maintenance personnel will tend not to carry a hammer because of its weight and size. A need exists for a tool usable for hammering that is structured to be held by jaws such as on adjustable plier that when clasped in such jaws such plier tool provides handle means for the portable hammering tool.

The invention is unlike the hammers with detachable or replaceable heads, which still require having the hammer, handle and some form of hammer receiver. The present invention is preferably formed in a single piece, and having a hammer head on a shaft, which typically has an offset area to provide a receiver for one jaw of a plier, the shaft having at the end opposite the hammer head end, a grip stem with generally planar surface features displaced irregularly around the stem. To a degree, the shape of the grip stem is made to conform to certain angular aspects of the jaws of adjustable or slip joint pliers. The overall shape enables the compound tool to have the utility of a portable hammer usable with another tool, the adjustable plier, that is most commonly carried by maintenance personnel.

DRAWINGS

FIG. 6 is an overhead view of an embodiment of the invention.

DETAILED DESCRIPTION

Figure 1:
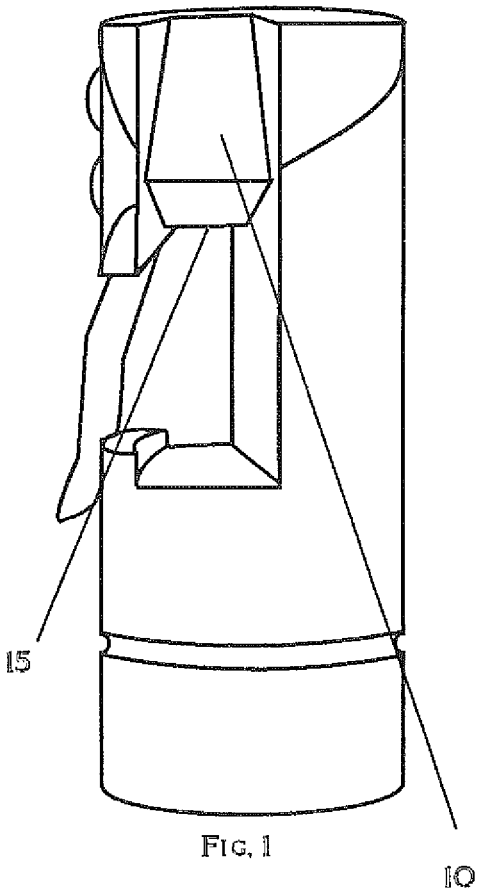
FIG. 1 is a right side view of an embodiment of the invention.
Figure 2:
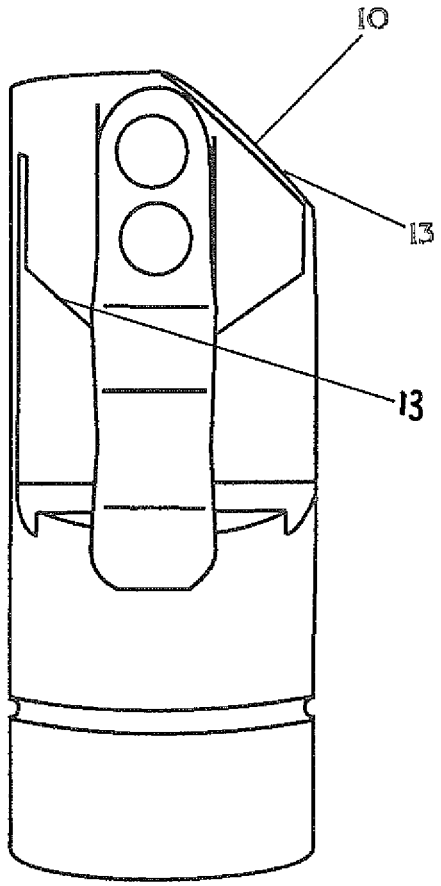
FIG. 2 is a front face view of an embodiment of the invention.
Figures 3, 4:
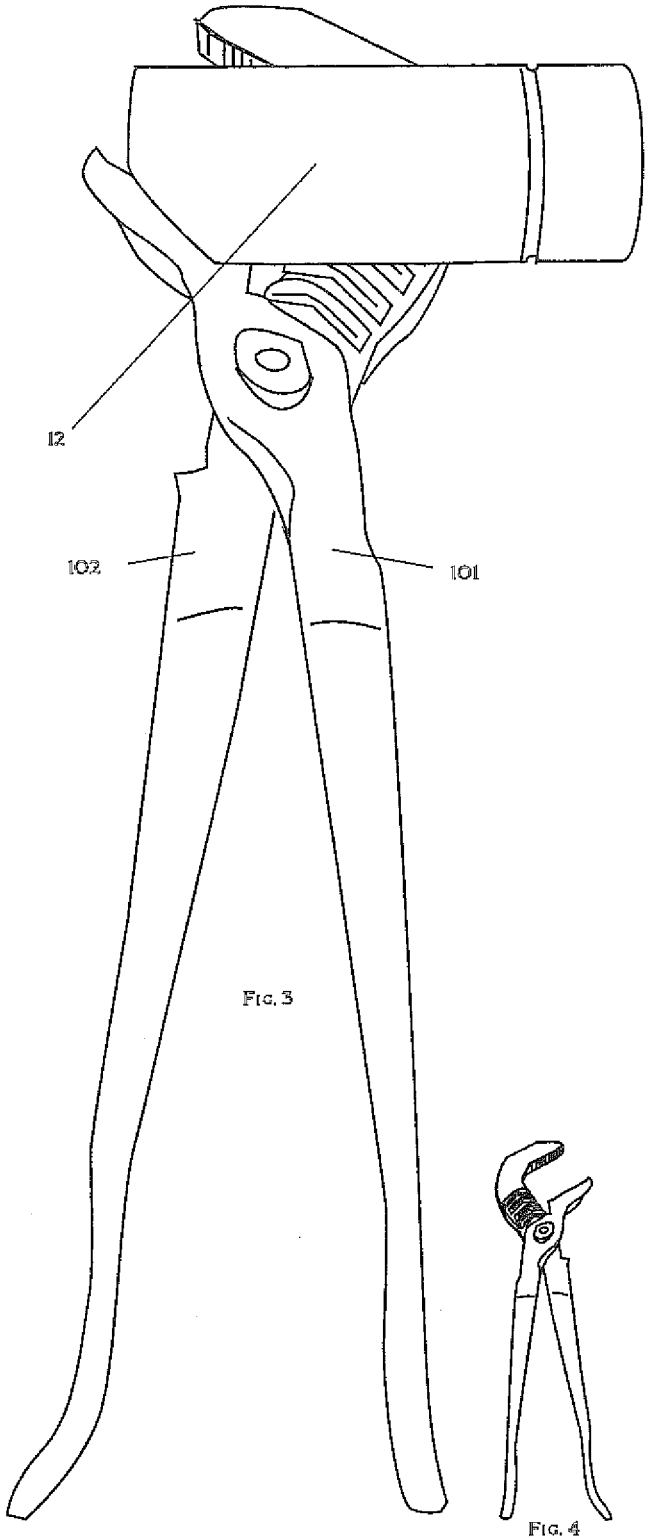
FIG. 3 is a rear view of an embodiment of the invention, held in the jaws of an adjustable plier.
FIG. 4 is a view of an adjustable plier.
Figure 5:
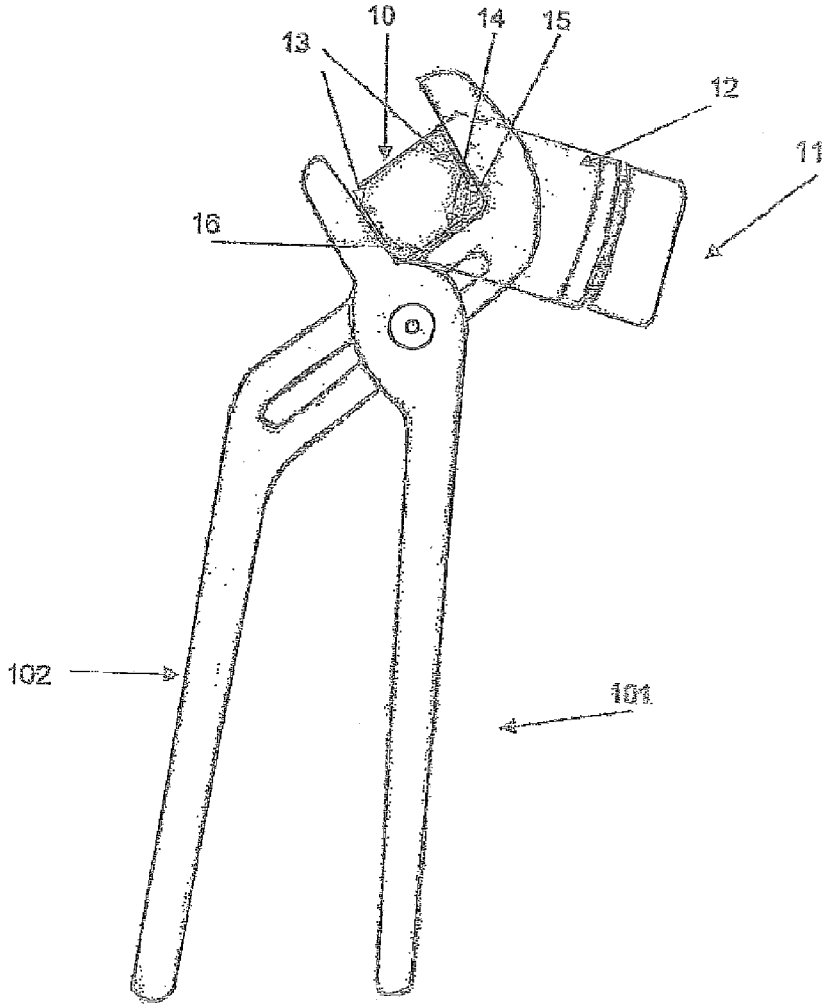
FIG. 5 is a front view of an embodiment of the invention, held in the jaws of an adjustable plier.

The following describes one typical and one preferred embodiment of the invention. The common adjustable plier, which is not part of the invention, has two jaws each operatively joined with a handle element. FIG. 4. In that common adjustable plier, one jaw and handle generally are linear in layout, and the other jaw and handle are displaced at angles to one another. As used herein, the term jaws refers to the working ends of the pliers, and jaw edges or jaw surfaces are that part of the jaw that contacts the workpiece. Some other common designs of adjustable pliers have modified the more linear jaw and handle design so that the jaw is angled away from the line of the handle, but still, the other jaw and handle will be displaced at angles.

The utility of many common adjustable pliers obtains from a slip joint that adjusts the distance between the jaw portions, while keeping the jaw surfaces in near parallel relationship. That parallel relation of the jaw surfaces conforms to the parallel surfaces on workpieces and fasteners such as bolt heads and threaded nuts. Adapted to the utility provided by the invention, the grip stem on the tool has parallel surfaces.

On these surfaces, the jaws of the adjustable pliers will grab the tool of the present invention.

When many common, slip joint adjustable pliers are in an upright position, with the handgrips positioned vertically, it will be observed that the jaws are angled in relation to grips. The slip joint design typically has one grip and jaw piece that has a semi-circular raised edge which slips into one of several semi-circular grooves on the second grip and jaw piece. For simplicity, the two parts of the plier may be referred to as the slip piece and the grooved piece. Typically, the slip piece is more linear from end to end than is the grooved piece.

The design of the grooved piece on a common pair of adjustable pliers is a linear shaft, which is the hand hold. A central portion of the piece is angled and that portion contains the grooves, and through that portion typically is a bolt that secures the grooved piece to the slip piece. That angled piece with the grooves angles back onto the jaw, and a typical relation between the jaw and the grooved piece is approximately 90 degrees. Adapted to provide the utility of the invention, the grip stem on the tool has a support surface that is at an approximate 90 degree angle with one of the parallel grip surfaces.

In one preferred embodiment an area between the support surface and the grip surface is cut away, which has been shown to provide a better fit against many common designs of adjustable pliers. In another preferred embodiment, the parallel surfaces of the grip stem are not flat and are substantially parallel, due to the jaw shape of some commonly-sold pliers. Another feature embodied in some implementations of the invention is a groove cut in a parallel surface of the grip stem, the groove being dimensioned as a hold for a jaw of the plier, said groove having edges that provide lateral control on the grip stem to keep the hammer head tool in place during use.

The slip piece of common adjustable plier has a generally linear shaft that extends to a central portion that contains the raised semi-circular edge that slips into the grooved piece, then extends to the jaw, which typically is slightly angled in relation to the shaft. The jaws on two pieces of the plier come in close relation when the jaw surfaces are closed together. To adapt to that, a corner of the grip stem on the invention may be cut away to allow for how the jaw piece come together near the point closest to central portion of each piece.

In plan view, one embodiment of a tool of the present invention is depicted with the hammer head at the left end of a shaft and the grip stem at the right end. Between the grip stem end of the tool and the hammer head end, is formed a receiver recess 17 into which the jaw of the plier is received. The striking portion of the hammer head is a generally flat surface, which is in perpendicular relation with the shaft. The grip stem is angled in relation to the shaft, as well as in relation to the striking surface of the hammer head. The grip stem has two parallel surfaces which are gripped by the jaw surfaces of the adjustable pliers, and has a support surface that contacts that part of the central portion of the grooved piece that is adjacent to the jaw surface. In one preferred embodiment, the rear portion of the tool runs between the parallel surfaces and serves as a chisel edge, a reaming tool, or wedge.

In use, the tool is gripped by the adjustable pliers closing on the grip stem such that the parallel surfaces on the grip stem are held between the jaw surfaces on the pliers, and with the support surface resting against the plier. The proper positioning results in the tool being held by the jaws such that the shaft of the tool and the shafts of the pliers are generally in a perpendicular relation. The angular relationship between the shaft of the grip stem and the parallel surfaces on the grip stems, and how those angles work with the angles of the plier handles and the parallel surfaces of the jaw surfaces. In the preferred embodiment, angles within the preferred ranges will result in the grips of the plier and the hammer head being positioned to comfortably and effectively use the compound tool for hammering.

As depicted in the drawings herewith, the two parts of the plier are the slip piece 101 and the grooved piece 102. The striking end is 18 and gripping end is 19. The grip stem on the invention is 10, the hammer head is 11, the shaft is 12. On the grip stem, the parallel surfaces are 13, and the support surface is 14. The receiver recess of one preferred embodiment is 17. Further, the cutaways used on one preferred embodiment, are depicted as 15 and 16.

The compound tool is suited to have a clasp bar attached to it. In the typical embodiment, the clasp provides the utility of clasping the tool to a belt or to a tool bag. In another embodiment, the clasp also serves a keeper to enclose one plier jaw that in in contact with the grip stem.

I claim as my invention:

1. A tool usable with adjustable pliers to provide a compound hammer tool comprising, a tool body having a striking end and gripping end, said tool body formed with a hammer head at said striking end, and a grip stem adjacent to said gripping end of said tool body, and a receiver recess formed in said tool body between said grip stem and said hammer head, said grip stem is formed with parallel surfaces and said grip stem extends away from said tool body.

2. The compound hammer tool of claim 1, wherein said grip stem has at least one support surface formed between said parallel surfaces.

3. The compound hammer tool of claim 1, wherein said gripping end is formed in a wedge.

4. The compound hammer tool of claim 1, further comprising a clasp bar joined to said gripping end and said clasp bar extends over said receiver recess.

5. A tool, comprising, a hammer head joined to a grip stem by a tool shaft, said hammer head extending from a striking end of said tool to said shaft and said grip stem joined to said shaft with an area of said shaft and said grip stem providing a receiver recess.

6. The tool of claim 5, wherein said grip stem has at least one support surface formed between a pair of parallel surfaces thereon.

7. The tool of claim 5, wherein said shaft extends past said grip stem and is formed in a wedge.

8. The tool of claim 5, further comprising a clasp bar joined to said grip stem and said clasp bar extends over said receiver recess.

* * * * *